US011569578B2

(12) United States Patent
Hasegawa

(10) Patent No.: US 11,569,578 B2
(45) Date of Patent: Jan. 31, 2023

(54) PATCH ANTENNA DEVICE

(71) Applicant: HARADA INDUSTRY CO., LTD., Tokyo (JP)

(72) Inventor: Ryohei Hasegawa, Tokyo (JP)

(73) Assignee: HARADA INDUSTRY CO, LTD., Tokyo (JP)

( * ) Notice: Subject to any disclaimer, the term of this patent is extended or adjusted under 35 U.S.C. 154(b) by 0 days.

(21) Appl. No.: 17/061,100

(22) Filed: Oct. 1, 2020

(65) Prior Publication Data

US 2021/0111491 A1 Apr. 15, 2021

(30) Foreign Application Priority Data

Oct. 10, 2019 (JP) ..... JP2019-186574

(51) Int. Cl.
*H01Q 9/04* (2006.01)
*H01Q 5/378* (2015.01)
*H01Q 19/00* (2006.01)

(52) U.S. Cl.
CPC ..... *H01Q 9/0407* (2013.01); *H01Q 5/378* (2015.01); *H01Q 19/005* (2013.01)

(58) Field of Classification Search
CPC ..... H01Q 1/32–38; H01Q 9/0407; H01Q 5/378–392
See application file for complete search history.

(56) References Cited

U.S. PATENT DOCUMENTS

2010/0171675 A1* 7/2010 Borja ..... H01Q 9/0414 343/798
2015/0194730 A1* 7/2015 Sudo ..... H01Q 5/378 343/905
2019/0020114 A1* 1/2019 Paulotto ..... H01Q 9/0442
2019/0280386 A1* 9/2019 Kowaita ..... H01Q 9/0407

FOREIGN PATENT DOCUMENTS

JP 2013183388 A 9/2013
JP 2019016930 A 1/2019
JP 2019161312 A 9/2019

* cited by examiner

*Primary Examiner* — Hasan Islam
(74) *Attorney, Agent, or Firm* — Global IP Counselors, LLP

(57) ABSTRACT

A patch antenna device configured to receive a radio communication signal includes a circuit board, a patch antenna, and a parasitic element. The circuit board has a signal processing circuit placed thereon. The patch antenna is stacked on the circuit board and has a quadrangular radiation element. The parasitic element is disposed above the patch antenna so as to improve antenna gain characteristics of the patch antenna and configured such that the length of the upper side of the parasitic element is shorter than the width in a plan view of the radiation element of the patch antenna and that the length between the upper and lower sides of the parasitic element is longer than the length between the upper and lower sides of the radiation element of the patch antenna.

6 Claims, 3 Drawing Sheets

PATCH ANTENNA DEVICE

CROSS-REFERENCE TO RELATED APPLICATIONS

This application claims priority to Japanese Patent Application No. 2019-186574 filed on Oct. 10, 2019.

BACKGROUND

Technical Field

The present invention generally relates to a patch antenna device, and more particularly to a patch antenna device with improved antenna gain characteristics.

Description of the Related Art

There is known a patch antenna for receiving a circularly polarized signal, which is constructed using a ceramic or dielectric substrate. Such a modularized patch antenna is accommodated in a low-profile antenna device mounted on a vehicle roof, for example, so as to realize communication such as GNSS (Global Navigation Satellite System) and SDARS (Satellite Digital Audio Radio Service). The low-profile antenna device includes, in addition to the patch antenna, antennas required to realize other communications, such as radio, television, and mobile phone.

Further, there is known an antenna device in which a parasitic element is disposed on a patch antenna for the purpose of improving the gain of the patch antenna (Japanese Patent Application Kokai Publication No. 2019-016930 referred to hereinafter as Patent Document 1). Specifically, in the antenna device disclosed in Patent Document 1, the patch antenna is fixed on a base, the parasitic element is fixed to an inner case covering the base, and the parasitic element functions as a wave director in a state where the antenna device is in an assembled state. The parasitic element has a quadrangular shape similar to a patch antenna having a quadrangular radiation element.

Further, there is known a micro-strip antenna having a hexagonal power feed element and a hexagonal parasitic element layered on the hexagonal power feed element concentrically and in parallel with respect thereto with a dielectric interposed therebetween (Japanese Patent Application Kokai Publication No. 2013-183388 referred to hereinafter as Patent Document 2).

Further, there is known a patch antenna in which a parasitic element having a three dimensional upwardly convex shape and having an area in a plan view larger than that of a radiation element is disposed so as to cover the radiation element (Japanese Patent Application Kokai Publication No. 2019-161312 referred to hereinafter as Patent Document 3).

When an antenna like a low-profile antenna including a plurality of various antennas is accommodated in a case, it is restricted in size due to the limited space in the case. Thus, for example, there may be a case where a wave director cannot be mounted on a patch antenna. In the antenna device of Patent Document 1, the parasitic element is fixed to the inner case side; however, the parasitic element has a quadrangular shape similar to the patch antenna, so that when the inner case has a shark-fin shape like a low-profile antenna device, the size of the inner case needs to match the size of the quadrangular parasitic element. This reduces the degree of freedom in design.

In the micro-strip antenna of Patent Document 2, the parasitic element has a shape similar to the power feed element and, thus, the degree of freedom in design is low.

Also in the patch antenna of Patent Document 3, the parasitic element has a three-dimensional convex shape, so that the thickness in the height direction is increased to inhibit size reduction.

SUMMARY

In view of the above situation, the present disclosure has been made and the object thereof is to provide a patch antennas device using a parasitic element functioning as a wave director for a patch antenna and contributing to a size reduction and an increase in design freedom.

In order to achieve the above object of the present disclosure, a patch antenna device may include: a circuit board on which a signal processing circuit is placed; a patch antenna stacked on the circuit board and having a quadrangular radiation element; and a parasitic element disposed above the patch antenna so as to improve antenna gain characteristics of the patch antenna and configured such that the length of the upper side of the parasitic element is shorter than the width in a plan view of the radiation element of the patch antenna and that the length between the upper and lower sides of the parasitic element is longer than the length between the upper and lower sides of the radiation element of the patch antenna.

The parasitic element may have a hexagonal shape including two opposing parallel sides and one side perpendicular to the two sides.

The center of the parasitic element may overlap the center of the patch antenna in a plan view.

The patch antenna may include a first patch antenna stacked on the circuit board and configured to receive signals in a first frequency band and a second patch antenna stacked on the first patch antenna and configured to receive signals in a second frequency band, and the parasitic element may be disposed above the second patch antenna so as to improve antenna gain characteristics of the second patch antenna and may be configured such that the length of the upper side of the parasitic element is shorter than the width in a plan view of the radiation element of the second patch antenna, and the length between the upper and lower sides of the parasitic element is longer than the length between the upper and lower sides of the radiation element of the second patch antenna.

The patch antenna device may further include an integrated resin holder for supporting the circuit board, first patch antenna, and parasitic element, wherein the parasitic element has held portions having at least two opposing parallel sides, and the integrated resin holder has at least a pair of parasitic element locking pawls that support the two sides of the held portions of the parasitic element so as to sandwich the parasitic element from both sides such that the distance between the second patch antenna and the parasitic element is kept constant.

The held portions of the parasitic element may be parasitic element locking concaves that the pair of parasitic element locking pawls lock.

The parasitic element locking concaves may include a right-trapezoidal concave having an opening width larger than the width of each parasitic element locking pawl and having an opening bottom width smaller than the width of each parasitic element locking pawl.

The patch antenna device may further include an insulating spacer disposed between the patch antenna and the parasitic element so as to support the parasitic element.

The patch antenna device according to the present disclosure has an advantage in that it uses the parasitic element functioning as a wave director for the patch antenna and contributing to a size reduction and an increase in design freedom.

DETAILED DESCRIPTION OF THE EMBODIMENTS

Figure 1:
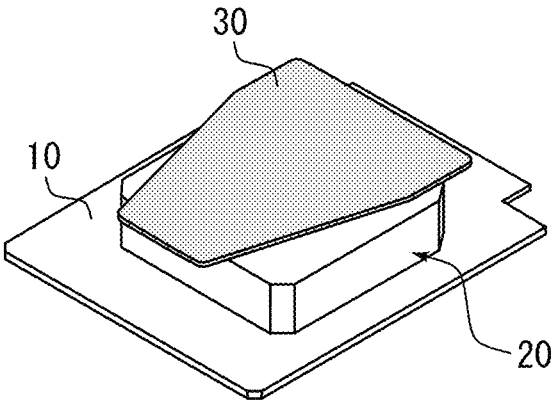
FIG. 1 is a schematic perspective view for explaining a patch antenna device according to one illustrated embodiment.
Figure 2:
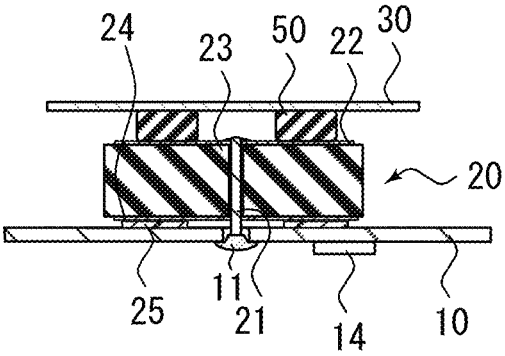
FIG. 2 is a schematic cross-sectional side view for explaining the patch antenna device according to the illustrated embodiment.
Figure 3:
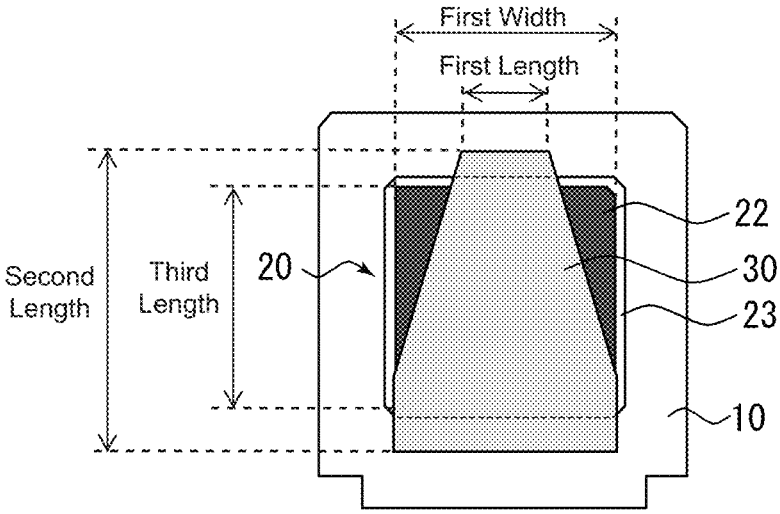
FIG. 3 is a schematic top view for explaining the patch antenna device according to the illustrated embodiment.

Preferred embodiments will be described below with reference to the accompanying drawings. FIG. 1 is a schematic perspective view for explaining a patch antenna device according to one illustrated embodiment. FIG. 2 is a schematic cross-sectional side view for explaining the patch antenna device according to the illustrated embodiment. FIG. 3 is a schematic top view for explaining the patch antenna device according to the illustrated embodiment. In FIGS. 2 and 3, the same reference numerals as those in FIG. 1 denote the same parts as those in FIG. 1. The patch antenna device according to the illustrated embodiment is configured to receive a radio communication signal. As illustrated, the patch antenna device according to the present disclosure mainly includes a circuit board 10, a patch antenna 20, and a parasitic element 30.

The circuit board 10 is a member on which a signal processing circuit is placed. A circuit pattern and a ground conductor pattern are formed by etching on the circuit board 10. An amplifier circuit 14 and the like may also be placed on the circuit board 10.

The patch antenna 20 is placed on the circuit board 10. The patch antenna 20 has a radiation element 22 having, e.g., a quadrangular shape. The illustrated patch antenna 20 is a ceramic patch antenna; however, the patch antenna according to the present invention is not limited to this, but may be an air-patch antenna using air as a dielectric, or may be a patch antenna using a synthetic resin as a dielectric or a patch antenna using a multilayer substrate as a dielectric. The patch antenna 20 is configured to receive signals in a frequency band for, e.g., SDARS, which is, specifically, 2.3 GHz band; however, the frequency band supported by the patch antenna 20 of the patch antenna device according to the present invention is not limited to the above frequency band and may be another frequency band. Specifically, the patch antenna 20 includes a power feed line 21 and a radiation element 22. The power feed line 21 is connected to a first power feed portion 11 of the circuit board 10. When the patch antenna 20 is a ceramic patch antenna as illustrated, a ceramic 23 is used as a dielectric. A ground conductor pattern 24 is provided on the back surface of the ceramic 23, thereby constituting a micro-strip antenna together with the radiation element 22. The patch antenna 20 is fixed onto the circuit board 10 by, e.g., a double-sided adhesive tape 25.

The parasitic element 30 is used for improving antenna gain characteristics of the patch antenna 20. The parasitic element 30 is disposed above the patch antenna 20. The parasitic element 30 is, e.g., a flat plate-like body. The parasitic element 30 is, e.g., made of a conductive plate. The parasitic element 30 is disposed parallel to and opposite to the radiation surface of the radiation element 22 of the patch antenna 20. When the patch antenna device according to the present disclosure is applied to, for example, a so-called shark-fin shaped low-profile antenna device, the upward direction in FIG. 3 corresponds to a vehicle travel direction and to the tip side of the shark-fin antenna. As illustrated in FIG. 3, in the parasitic element 30 used in the patch antenna device according to the present disclosure, the length (e.g., "first length") of the upper side of the parasitic element 30 is shorter than the width (e.g., "First Width") in a plan view of the radiation element 22 of the patch antenna 20. Further, the length (e.g., "Second Length") between the upper and lower sides of the parasitic element 30 is longer than the length (e.g., "Third Length") between the upper and lower sides of the radiation element 22 of the patch antenna 20. Specifically, the parasitic element 30 of the patch antenna device according to the present disclosure is, e.g., a hexagonal plate-like body as illustrated. More specifically, the parasitic element 30 has a hexagonal shape having two opposing parallel left and right sides, a lower side perpendicular to the two sides, and an upper side shorter than the lower side and parallel to the lower side. Further, as illustrated in FIG. 3, the parasitic element 30 is disposed such that the center thereof overlaps the center of patch antenna 20 in a plan view.

As illustrated in FIG. 2, the parasitic element 30 is disposed above the patch antenna 20 with an insulating spacer 50 interposed therebetween. The insulating spacer 50 is disposed between the patch antenna 20 and the parasitic element 30 so as to support the parasitic element 30.

As described above, the patch antenna device according to the present disclosure has the parasitic element functioning as a wave director for the patch antenna and contributing to a size reduction and an increase in design freedom. That is, the length of the upper side of the parasitic element is shorter than the width of the patch antenna, so that the parasitic element for improving antenna gain characteristics can be disposed in a tapered area of the tip of a so-called shark-fin antenna. Further, the parasitic element having a flat plate-like shape is disposed parallel to and opposite to the radiation surface of the radiation element of the patch antenna, whereby the thickness of the entire patch antenna device can be reduced.

Figure 4:
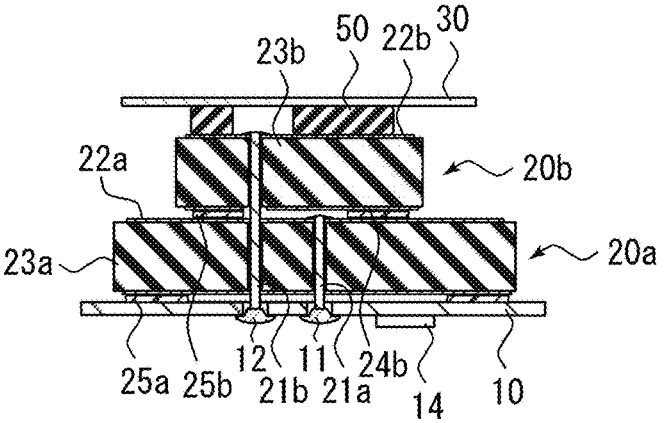
FIG. 4 is a schematic cross-sectional side view for explaining a configuration obtained by applying the patch antenna device according to the illustrated embodiment to a stacked patch antenna device.

In the above illustrated example, the patch antenna device uses one patch antenna; however, the present disclosure can be applied to a stacked patch antenna device having a stacking structure using a plurality of patch antennas. FIG. 4 is a schematic cross-sectional side view for explaining a configuration obtained by applying the patch antenna device according to the illustrated disclosure to a stacked patch antenna device. In FIG. 4, the same reference numerals as those in FIG. 1 denote the same parts as those in FIG. 1. As illustrated, in this example, as the patch antenna, a first patch antenna 20*a* and a second patch antenna 20*b* are provided.

The first patch antenna 20*a* is stacked on the circuit board 10 and configured to receive signals in a first frequency band. The first frequency band may be a frequency band for, e.g., GNSS, which ranges from 1 GHz to 2 GHz; however, the frequency band supported by the first patch antenna 20*a* of the patch antenna device according to the present invention is not limited to the above frequency band and may be another frequency band. The first patch antenna 20*a* includes a first power feed line 21*a* and a first radiation element 22*a*. The first power feed line 21*a* is connected to the first power feed portion 11 of the circuit board 10. The first patch antenna 20*a* is fixed onto the circuit board 10 by, e.g., a double-sided adhesive tape 25*a*. In the illustrated example, the first patch antenna 20*a* is a ceramic patch antenna using a ceramic 23*a* as a dielectric; however, the first patch antenna 20*a* of the patch antenna device according to the present invention is not limited to this, but may be an air-patch antenna using air as a dielectric, a patch antenna using a synthetic resin as a dielectric, or a patch antenna using a multilayer substrate as a dielectric.

The second patch antenna 20*b* is stacked on the first patch antenna 20*a* and configured to receive signals in a second frequency band. The second frequency band may be a frequency band for, e.g., SDARS, which is, specifically, 2.3 GHz band; however, the frequency band supported by the second patch antenna 20*b* of the patch antenna device according to the present invention is not limited to the above frequency band and may be another frequency band which is higher than the first frequency band. The second patch antenna 20*b* includes a second power feed line 21*b* and a second radiation element 22*b*. The second power feed line 21*b* is connected to a second power feed portion 12 of the circuit board 10. The second patch antenna 20*b* is fixed onto the first patch antenna 20*a* by, e.g., a double-sided adhesive tape 25*b*. In the illustrated example, the second patch antenna 20*b* is a ceramic patch antenna using a ceramic 23*b* as a dielectric; however, the second patch antenna 20*b* of the patch antenna device according to the present invention is not limited to this, but may be an air-patch antenna using air as a dielectric, a patch antenna using a synthetic resin as a dielectric, or a patch antenna using a multilayer substrate as a dielectric.

The parasitic element 30 is disposed above the second patch antenna 20*b* and used for improving antenna gain characteristics of the second patch antenna 20*b*. In such a stacked patch antenna device, the length (e.g., "First Length") of the upper side of the parasitic element 30 is shorter than the width (e.g., "Second Width") in a plan view of the radiation element 22*b* of the second patch antenna 20*b*, and the length (e.g., "Second Length") between the upper and lower sides of the parasitic element 30 is longer than the length ("Fourth Length") between the upper and lower sides of the radiation element 22*b* of the second patch antenna 20*b*.

Figure 5:
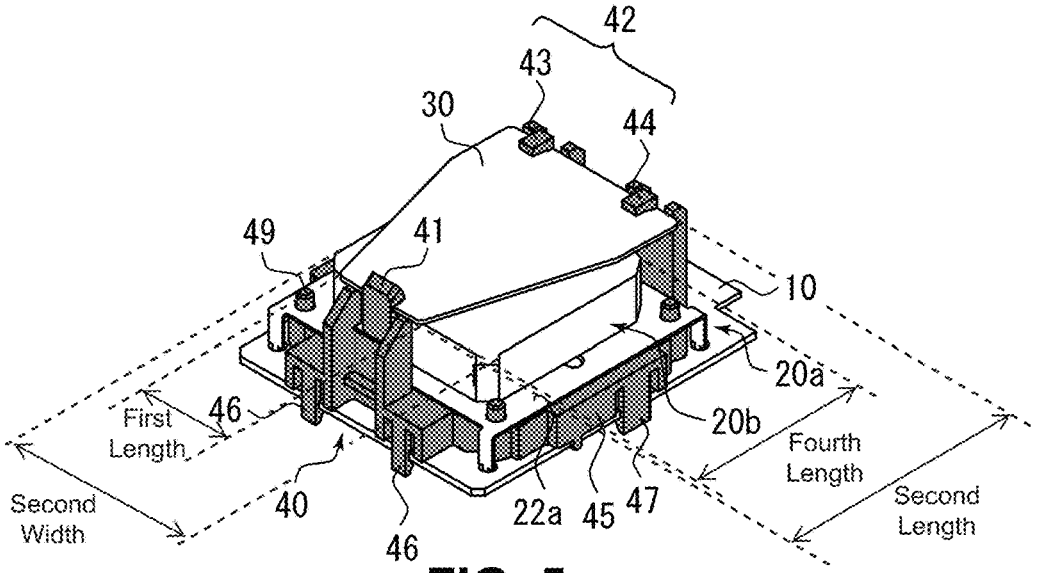
FIG. 5 is a schematic perspective view for explaining another stacked patch antenna device to which the patch antenna device according to the illustrated disclosure is applied.

In the above illustrated example, the parasitic element 30 is supported by the insulating spacer 50; however, the present invention is not limited to this. For example, as illustrated in FIG. 5, the parasitic element may be supported by an integrated resin holder. FIG. 5 is a schematic perspective view for explaining another stacked patch antenna device to which the patch antenna device according to the illustrated disclosure is applied. In FIG. 5, the same reference numerals as those in FIG. 1 denote the same parts as those in FIG. 1. In this example, the parasitic element 30 is supported by an integrated resin holder 40. The integrated resin holder 40 supports the circuit board 10, the first patch antenna 20*a*, and the parasitic element 30. The illustrated first patch antenna 20*a* is a plate-like air patch antenna; however, the patch antenna according to the present invention is not limited to this, but may be a patch antenna using, as a dielectric, a ceramic, a synthetic resin, or a multilayer substrate. The circuit board 10 has a ground conductor pattern. The ground conductor pattern constitutes a microstrip antenna together with the first radiation element 22*a*. The illustrated first radiation element 22*a* is a quadrangular plate-like element and is disposed opposite to the circuit board 10 with a predetermined interval therefrom. In the illustrated patch antenna 20*a*, the power feed line 21*a* is formed by cutting and bending a part of the radiation surface of the quadrangular plate-like element.

Figure 6:
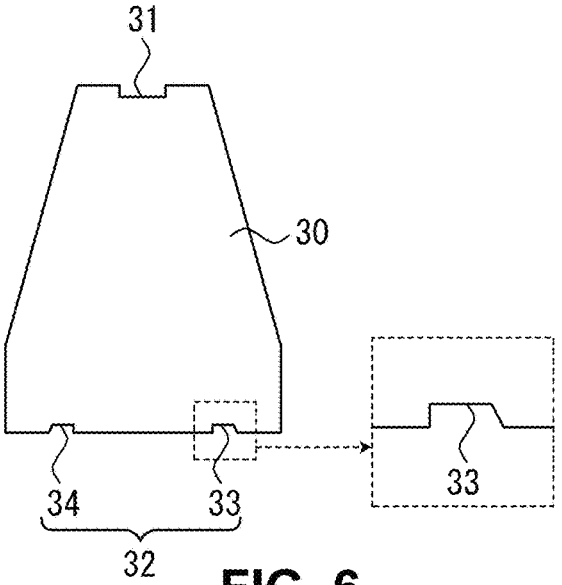
FIG. 6 is a schematic top view for explaining a parasitic element of the patch antenna device according to the illustrated embodiment.

Details of the parasitic element 30 suitable for the patch antenna device according to the present disclosure that uses the integrated resin holder 40 will be described more specifically with reference to FIG. 6. FIG. 6 is a schematic top view for explaining the parasitic element of the patch antenna device according to the illustrated disclosure. In FIG. 6, the same reference numerals as those in FIG. 1 denote the same parts as those in FIG. 1. When the patch antenna device according to the present disclosure is applied to, for example, a so-called shark-fin shaped low-profile antenna device, the upward direction in FIG. 6 corresponds to a vehicle travel direction and to the tip side of the shark-fin antenna. The parasitic element 30 of the patch antenna device according to the present disclosure has held portions 31, 32 having at least two sides opposed to each other. For example, the parasitic element 30 has a hexagonal plate-like body as illustrated. Specifically, the held portions 31, 32 of the parasitic element 30 are formed in the opposing parallel upper and lower sides, respectively. In the example of FIG. 6, the parasitic element 30 has a hexagonal shape having two opposing left and right sides, a lower side perpendicular to the two sides, and an upper side shorter than the lower side and parallel to the lower side. By forming the held portions 31, 32 in the opposing parallel upper and lower sides, respectively, the parasitic element 30 can be supported by the integrated resin holder 40 so as to be sandwiched thereby from both sides in the horizontal direction. The held portions 31, 32 of the parasitic element 30 are configured as parasitic element locking concaves that parasitic element locking pawls 41, 42 of the integrated resin holder 40 lock. That is, the bottom sides of the parasitic element locking concaves of the held portions are the two opposing parallel sides. The presence of the parasitic element locking concaves of the held portions 31, 32 allows the position of the parasitic element 30 with respect to the second patch antenna 20*b* to be accurately fixed. Details of the parasitic element locking concaves of the held portions 31, 32 will be described later. In the patch antenna device according to the present disclosure, the shape of the parasitic element 30 is not limited to a hexagon and may be, for example, a trapezoid. Specifically, the trapezoid may be a quadrangle having the upper side shorter than the lower side and parallel to the lower side.

Referring again to FIG. 5, the integrated resin holder 40 will be described. The integrated resin holder 40 is a member for supporting the circuit board 10 and the parasitic element 30. The integrated resin holder 40 has at least a pair of parasitic element locking pawls 41, 42. The parasitic element locking pawls 41, 42 support the two sides of the held portions 31, 32 of the parasitic element 30 so as to sandwich the parasitic element 30 from both sides in the horizontal direction such that the distance between the second patch antenna 20*b* and the parasitic element 30 is kept constant. The integrated resin holder 40 is made of insulating resin. The parasitic element locking pawls 41, 42 each pinch the front and back surfaces of the parasitic element 30 so as to keep the position of the parasitic element 30 in the height direction constant.

As illustrated, when a plate-like air patch antenna is used as the first patch antenna 20*a*, the integrated resin holder 40 may further have a plate support portion 45 that is disposed between the plate-like air patch antenna and the circuit board 10 and supports the plate-like air patch antenna. That is, the integrated resin holder 40 may be configured to support also the first radiation element 22*a* of the plate-like air patch antenna. The use of the plate support portion 45 can prevent the first radiation element 22*a* of the first patch antenna 20*a* from being bent due to vibration or the like. Further, bosses 49 protrude from the plate support portion 45 of the integrated resin holder 40. The bosses 49 are inserted into fixing holes formed in the first patch antenna 20*a* for thermal welding, whereby the first patch antenna 20*a* is fixed to the integrated resin holder 40. Alternatively, the first patch antenna 20*a* may be fixed to the integrated resin holder 40 by means of screws. The integrated resin holder 40 has the plate support portion 45 as a center component and further has the parasitic element locking pawls 41, 42 and the circuit board locking pawls 46, 47 on the upper and lower sides of the plate support portion 45, respectively.

The parasitic element locking pawls 41, 42 extend from the plate support portion 45 toward the parasitic element 30 to hold the parasitic element 30. The parasitic element locking pawls 41, 42 lock the held portions 31, 32 formed in the upper and lower sides of the parasitic element 30 having, e.g., a hexagonal shape as illustrated in FIG. 6 so as to pinch them. The held portions 31, 32 of the parasitic element 30 are configured as the parasitic element locking concaves that the parasitic element locking pawls 41, 42 lock. That is, the parasitic element 30 has concaves as the held portions at positions corresponding to the parasitic element locking pawls 41, 42. In the illustrated example, the parasitic element locking pawl 42, which is one of the parasitic element locking pawls that support the held portions 31, 32 having two opposing parallel sides of the parasitic element 30 so as to sandwich the parasitic element 30 from both sides in the horizontal direction, includes two side-by-side locking pawls 43, 44. Correspondingly, the held portion 32 of the parasitic element 30 includes side-by-side locking concaves 33, 34. The side-by-side locking concaves 33, 34 are locked by the side-by-side locking pawls 43, 44, respectively. The side-by-side locking concaves 33, 34 each preferably have a right-trapezoidal concave having an opening width larger than the width of each locking pawl and having an opening bottom width smaller than the width of each locking pawl. Further, the right-angled portions of the right-trapezoidal concaves of the respective side-by-side locking concaves 33, 34 are preferably positioned on a side close to each of the side-by-side locking concaves 33, 34, respectively. The oblique sides are preferably positioned on a side far from each of the side-by-side locking concaves 33, 34, respectively. More specifically, the right-angled portion of the locking concave 33 is positioned at the corner close to the locking concave 34, and the right-angled portion of the locking concave 34 is positioned at the corner close to the locking concave 33. Thus, when the parasitic element 30 is locked by the parasitic element locking pawls 41, 42 (43, 44), the parasitic element locking pawls 41, 42 (43, 44) are press-fit to the locking concaves of the held portions 31, 32 (33, 34), whereby the parasitic element 30 is fixed to the integrated resin holder 40 with the horizontal movement restricted.

Figure 7:
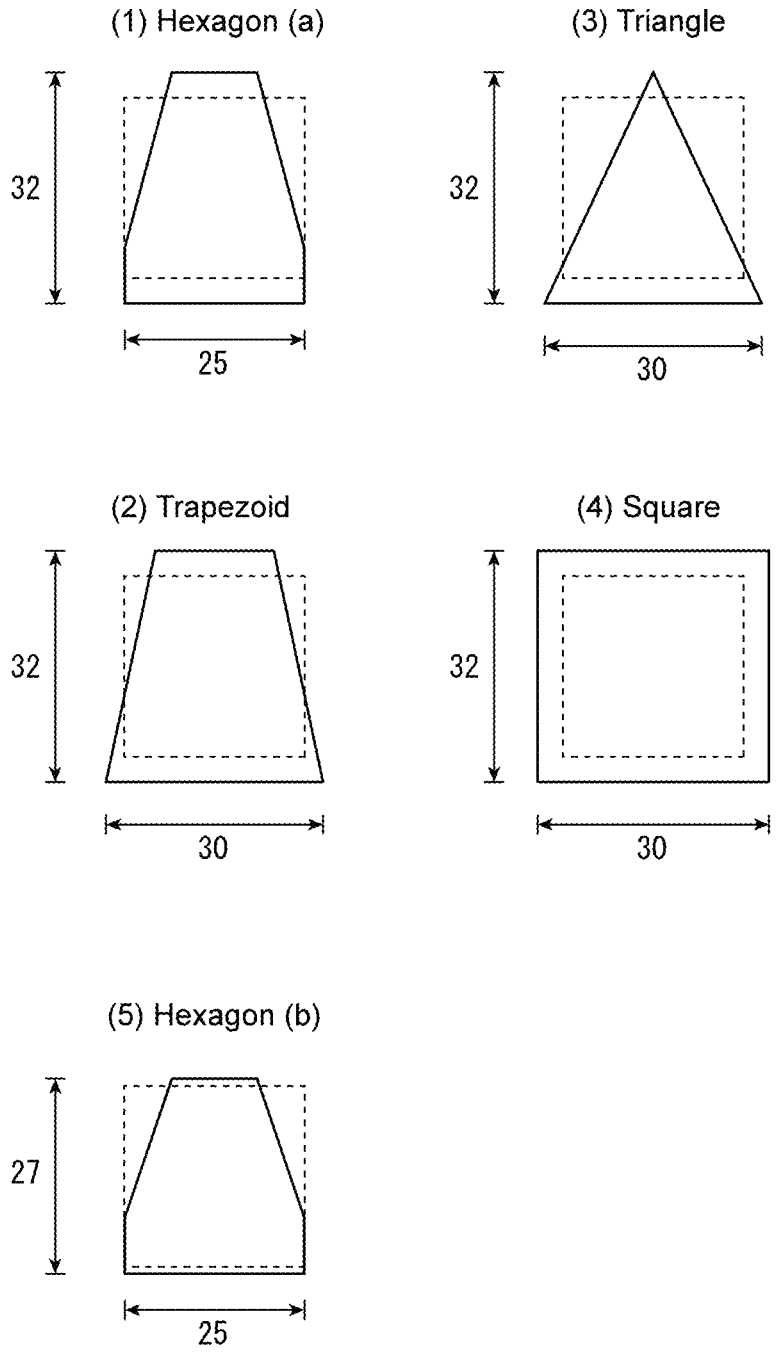
FIG. 7 is a view for explaining a change in antenna gain characteristics of a patch antenna due to a difference in the shape of the parasitic element of the patch antenna device according to the illustrated embodiment, which illustrates shape variations of the parasitic element.

The following describes a change in the antenna gain characteristics of the patch antenna due to a difference in the shape of the parasitic element of the patch antenna device according to the present disclosure. FIG. 7 is a view for explaining a change in the antenna gain characteristics of the patch antenna due to a difference in the shape of the parasitic element of the patch antenna device according to the present disclosure, which illustrates shape variations of the parasitic element. Measurement was made using the configuration of the patch antenna device illustrated in FIG. 1 under the following conditions. The size of the radiation element of the patch antenna was 25 mm×25 mm. The distance between the radiation element of the patch antenna and the parasitic element was 3 mm. Parasitic elements of five different shapes illustrated in FIG. 7 were used. That is, the five different shapes were (1) hexagon (a) (lower side: 25 mm, height: 32 mm), (2) trapezoid (lower side: 30 mm, height: 32 mm), (3) triangle (lower side: 30 mm, height 32 mm), (4) square (lower side: 32 mm, height: 32 mm), and (5) hexagon (b) (lower side: 25 mm, height: 27 mm). Under the above conditions, the radiation characteristics of the patch antenna at 2330 MHz was measured. The table shown below is a horizontal plane average gain for each shape of the parasitic element. The patch antenna device according to the present invention is not limited to the above specific sizes or frequencies, and these numerical values are merely examples.

TABLE 1

| | Hexagon (a) | Trapezoid | Triangle | Hexagon (b) | Square |
|---|---|---|---|---|---|
| Horizontal plane average gain (dB) | −10.8 | −11.1 | −12.0 | −12.2 | −12.6 |

From these results, it can be seen that the parasitic elements having (1) hexagonal shape (a) and (2) trapezoidal shape are high in the horizontal plane average gain and are suitable examples. Further, the horizontal plane average gain is higher in the case where the length between the upper and lower sides is long as in (1) hexagon (a) than in the case where the length between the upper and lower sides is short as in (5) hexagon (b). Further, the horizontal plane average gain becomes low in an extremely pointed shape like (3) triangle having no upper side. Thus, the parasitic element of the patch antenna device according to the present disclosure is preferably configured such that the length of the upper side is shorter than the width in a plan view of the radiation element of the patch antenna and that the length between the upper and lower sides is longer than the length between the upper and lower sides of the radiation element of the patch antenna.

The patch antenna device according to the present invention is not limited to the above illustrated examples but may be variously modified without departing from the scope of the present invention.

What is claimed is:

1. A patch antenna device configured to receive radio communication signals, the patch antenna device comprising:

a circuit board on which a signal processing circuit is placed;

a patch antenna stacked on the circuit board and having a quadrangular radiation element, the patch antenna including a first patch antenna stacked on the circuit board and configured to receive signals in a first frequency band and a second patch antenna stacked on the first patch antenna and configured to receive signals in a second frequency band;

a parasitic element disposed above the second patch antenna so as to improve antenna gain characteristics of the second patch antenna and configured such that a first length of an upper side of the parasitic element is shorter than an element width in a plan view of the quadrangular radiation element of the second patch antenna and such that a second length between the upper side and a lower side of the parasitic element is longer than an element length between upper and lower sides of the quadrangular radiation element of the second patch antenna; and an integrated resin holder supporting the circuit board, the first patch antenna, and the parasitic element, the parasitic element including held portions having at least two opposing parallel sides, and the integrated resin holder including at least a pair of parasitic element locking pawls that support the two sides of the held portions of the parasitic element so as to sandwich the parasitic element from both sides such that the distance between the second patch antenna and the parasitic element is kept constant.

2. The patch antenna device according to claim 1, wherein the held portions of the parasitic element are parasitic element locking concaves that the pair of parasitic element locking pawls lock.

3. The patch antenna device according to claim 2, wherein the parasitic element locking concaves include a right-trapezoidal concave having an opening width larger than a width of each parasitic element locking pawl and having an opening bottom width smaller than the width of each parasitic element locking pawl.

4. The patch antenna device according to claim 1, further comprising an insulating spacer disposed between the patch antenna and the parasitic element so as to support the parasitic element.

5. The patch antenna device according to claim 1, wherein the parasitic element has a hexagonal shape including two opposing parallel sides and one side perpendicular to the two sides.

6. The patch antenna device according to claim 1, wherein a center of the parasitic element overlaps a center of the patch antenna in the plan view.

* * * * *